US008066205B2

(12) United States Patent
Bass et al.

(10) Patent No.: US 8,066,205 B2
(45) Date of Patent: Nov. 29, 2011

(54) PRESSURE-SIPHON SWITCH FOR PNEUMATIC SPRAY GUN

(75) Inventors: Gary S. Bass, Independence, KY (US); Ronald J. Mulford, Aurora, IN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 187 days.

(21) Appl. No.: 12/346,110

(22) Filed: Dec. 30, 2008

(65) Prior Publication Data

US 2010/0163649 A1 Jul. 1, 2010

(51) Int. Cl.
*B05B 7/02* (2006.01)

(52) U.S. Cl. ..... 239/526; 239/337

(58) Field of Classification Search ..... 239/526, 239/302, 337, 338, 345, 347, 348, 373, 375, 239/569, 581.1
See application file for complete search history.

(56) References Cited

U.S. PATENT DOCUMENTS

| | | | | |
|---|---|---|---|---|
| 1,744,208 | A | 1/1930 | Buchanan | |
| 2,670,239 | A | 2/1954 | Ditch | |
| 2,688,423 | A * | 9/1954 | Davis | 406/132 |
| 2,880,940 | A | 4/1959 | Briggs | |
| 2,904,262 | A | 9/1959 | Peeps | |
| 2,934,246 | A | 4/1960 | Briggs | |
| 4,760,962 | A | 8/1988 | Wheeler | |
| 5,058,807 | A * | 10/1991 | Smith | 239/302 |
| 5,251,822 | A | 10/1993 | Wang | |
| 6,254,267 | B1 * | 7/2001 | Arnaud | 366/137.1 |
| 6,296,229 | B1 * | 10/2001 | Giacomini | 251/314 |
| 6,626,382 | B1 | 9/2003 | Liu | |
| 2006/0175434 | A1 * | 8/2006 | Escoto et al. | 239/302 |

OTHER PUBLICATIONS

Office Action mailed Dec. 3, 2010 in co-pending U.S. Appl. No. 12/346,084, filed Dec. 30, 2008.
Amendment filed in co-pending U.S. Appl. No. 12/346,084, filed Dec. 30, 2008.

* cited by examiner

*Primary Examiner* — David Hwu
(74) *Attorney, Agent, or Firm* — Jones Day

(57) ABSTRACT

An apparatus for use with a paint container includes a nozzle and a housing. The nozzle receives paint from the container. The housing has a handle, an air inlet, and an air flow path configured to direct air from the inlet into the container. A valve body opens and closes the air flow path into the container upon moving back and forth between open and closed positions. The valve body moves between those positions by rotating about an axis without moving along the axis.

10 Claims, 19 Drawing Sheets

PRESSURE-SIPHON SWITCH FOR PNEUMATIC SPRAY GUN

TECHNICAL FIELD

This technology relates to a pneumatically operated spray gun.

BACKGROUND

A hand-held spray gun for paint operates under the power of pressurized air. The spray gun has a nozzle and a trigger. When the user depresses the trigger, valves inside the spray gun enable the pressurized air to spray a stream of paint outward from the nozzle. If the spray gun is in a pressure mode of operation, the pressurized air is directed into the container to force the paint outward from the container to the nozzle. If the spray gun is in a siphon mode of operation, the container is vented to the atmosphere, and the paint is drawn outward from the container by the suction of the air flowing past the nozzle.

SUMMARY OF THE INVENTION

An apparatus for use with a paint container includes a nozzle and a housing. The nozzle receives paint from the container. The housing has a handle, an air inlet, and an air flow path configured to direct air from the inlet into the container. A valve body opens and closes the air flow path into the container upon moving back and forth between open and closed positions. The valve body moves between those positions by rotating about an axis without moving along the axis.

DETAILED DESCRIPTION

Figure 1:
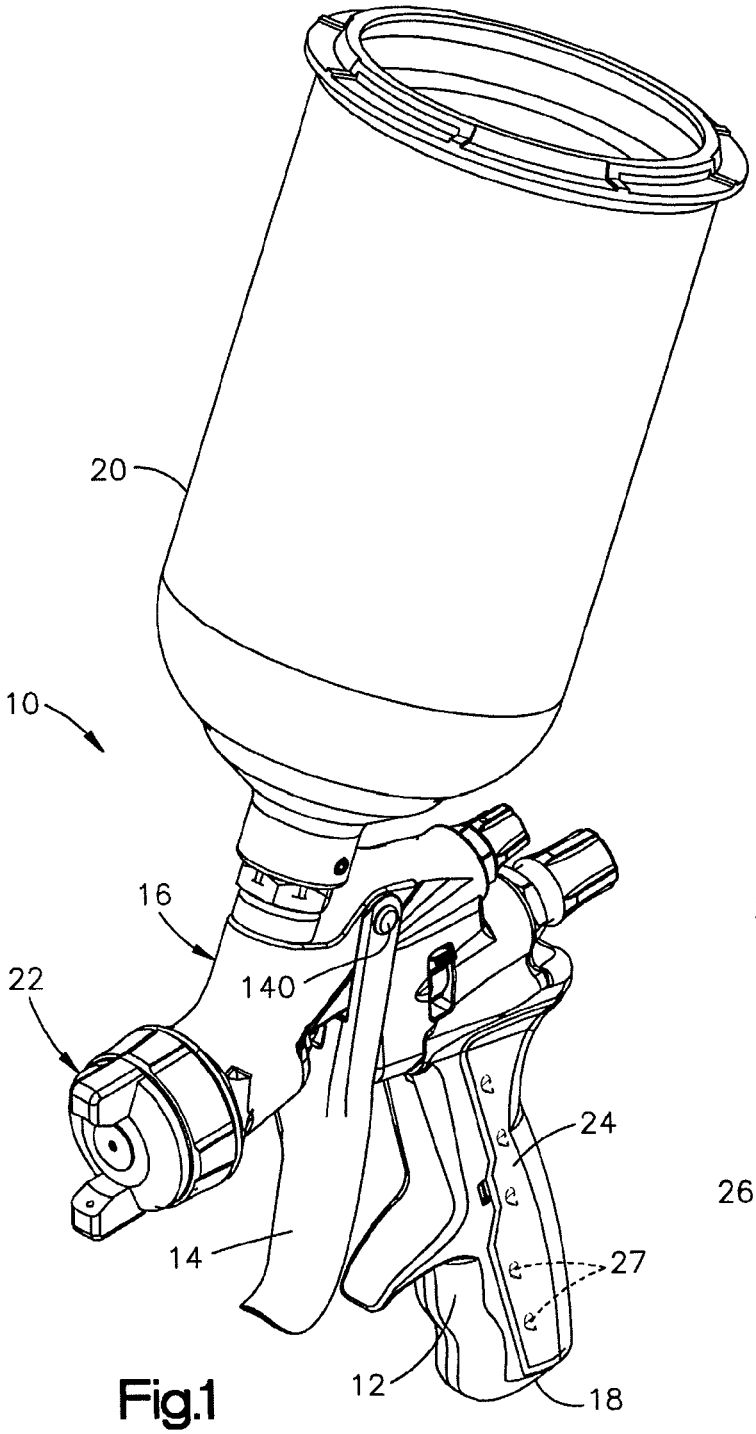
FIG. 1 is a perspective view of a hand-held paint spray gun with a paint container.
Figure 2:
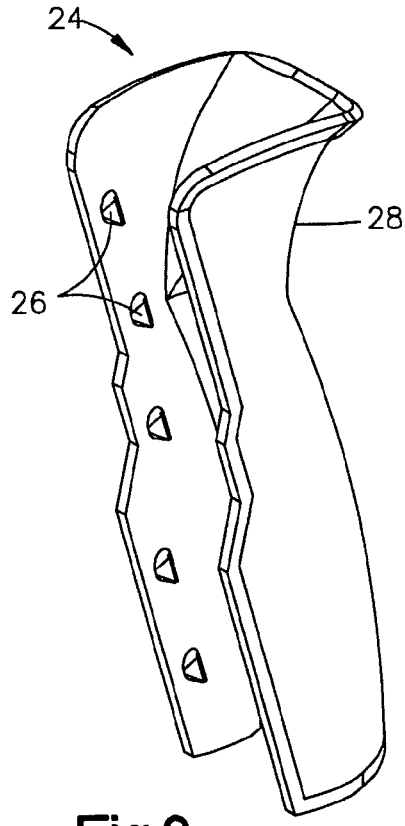
FIG. 2 is a perspective view of a part of the spray gun.

The paint spray guns shown in the drawings have parts that are examples of the structural elements recited in the claims. The illustrated spray guns thus include examples of how a person of ordinary skill in the art can make and use the claimed invention. They are described here to meet the enablement and best mode requirements of the patent statute without imposing limitations that are not recited in the claims.

First Embodiment

A first spray gun 10 is shown in FIGS. 1-18. As shown in FIG. 1, this spray gun 10 is a hand-held device with a handle 12 and a trigger 14. The handle 12 is configured as a pistol grip, and is part of an aluminum housing 16. The housing 16 is configured to receive pressurized air from a hose connected to an inlet 18 at the bottom of the handle 12. A container 20 of paint is mounted on the top of the housing 16. Other parts of the spray gun 10 form a nozzle assembly 22 at the front of the housing 16. Flow control devices inside the housing 16 cooperate with the trigger 14 for the pressurized air to spray the paint outward from the nozzle assembly 22.

In the illustrated embodiment, an optional grip pad 24 is mounted on the handle 12. As shown separately in FIG. 2, the grip pad 24 is a generally trough-shaped plastic part. The inner surface contour of the grip pad 24 is the same as the outer surface contour at the rear of the handle 12 so that the grip pad 24 fits closely over the handle 12. Rows of teeth 26 on opposite inner sides of the grip pad 24 snap into and out of corresponding recesses 27 at opposite sides of the handle 12 so that the grip pad 24 can be easily installed and removed for cleaning or replacement. An overmold layer 28 of the grip pad 24 is formed of a relatively soft plastic material for comfort.

Figure 3:
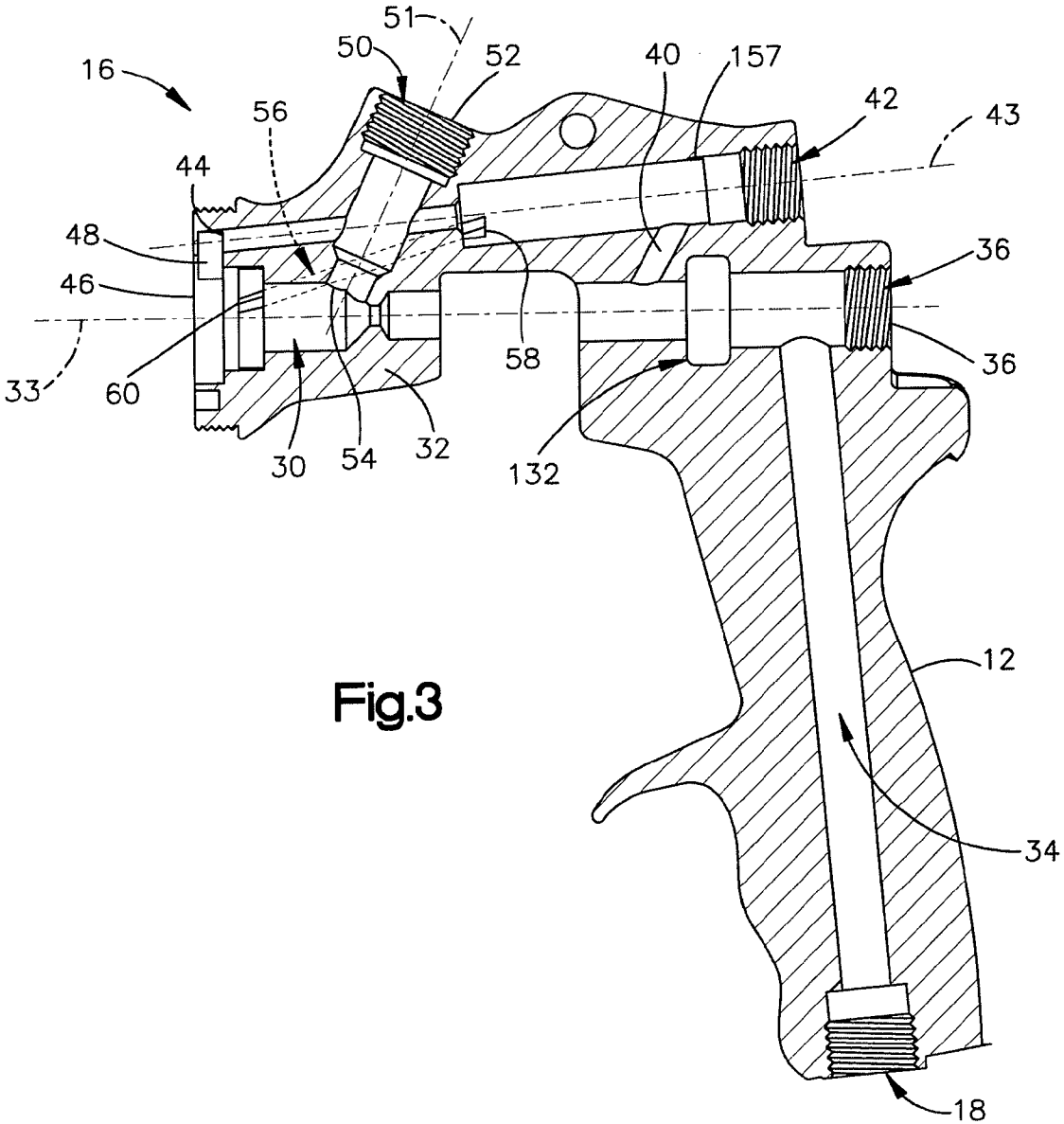
FIG. 3 is a sectional view of a part of the spray gun.

As shown separately in FIG. 3, the housing 16 has an array of bores and passages. These include a first bore 30 that extends through a front portion 32 of the housing 16. The first bore 30 has a longitudinal central axis 33 that is horizontal when the housing 16 is in the upright position shown in FIG. 3. An air supply passage 34 extends from the inlet 18 upward through the handle 12. A second bore 36 extends through the housing 16 above the air supply passage 34, and is coaxial with the first bore 30.

An intermediate air flow passage 40 extends upward from the second bore 36 to a third bore 42. The third bore 42 has a longitudinal central axis 43 that is inclined downward toward the axis 33 of the first bore 30, and has a front end 44 that is spaced inward from the front end 46 of the first bore 30. A front end passage 48 communicates the third bore 42 with the first bore 30 at that location.

A fourth bore 50 is centered on a more steeply inclined axis 51, and has an upper end 52 at the top of the housing 16. The fourth bore 50 intersects and extends across the third bore 42, and has a lower end 54 at which it intersects the first bore 30.

Twin passages 56 are located on opposite sides of the fourth bore 50. One of the twin passages 56 is shown partially in FIG. 3. The twin passages 56 are alike, and each has an upper end 58 in the third bore 42 and a lower end 60 in the first bore 30.

Figure 4:
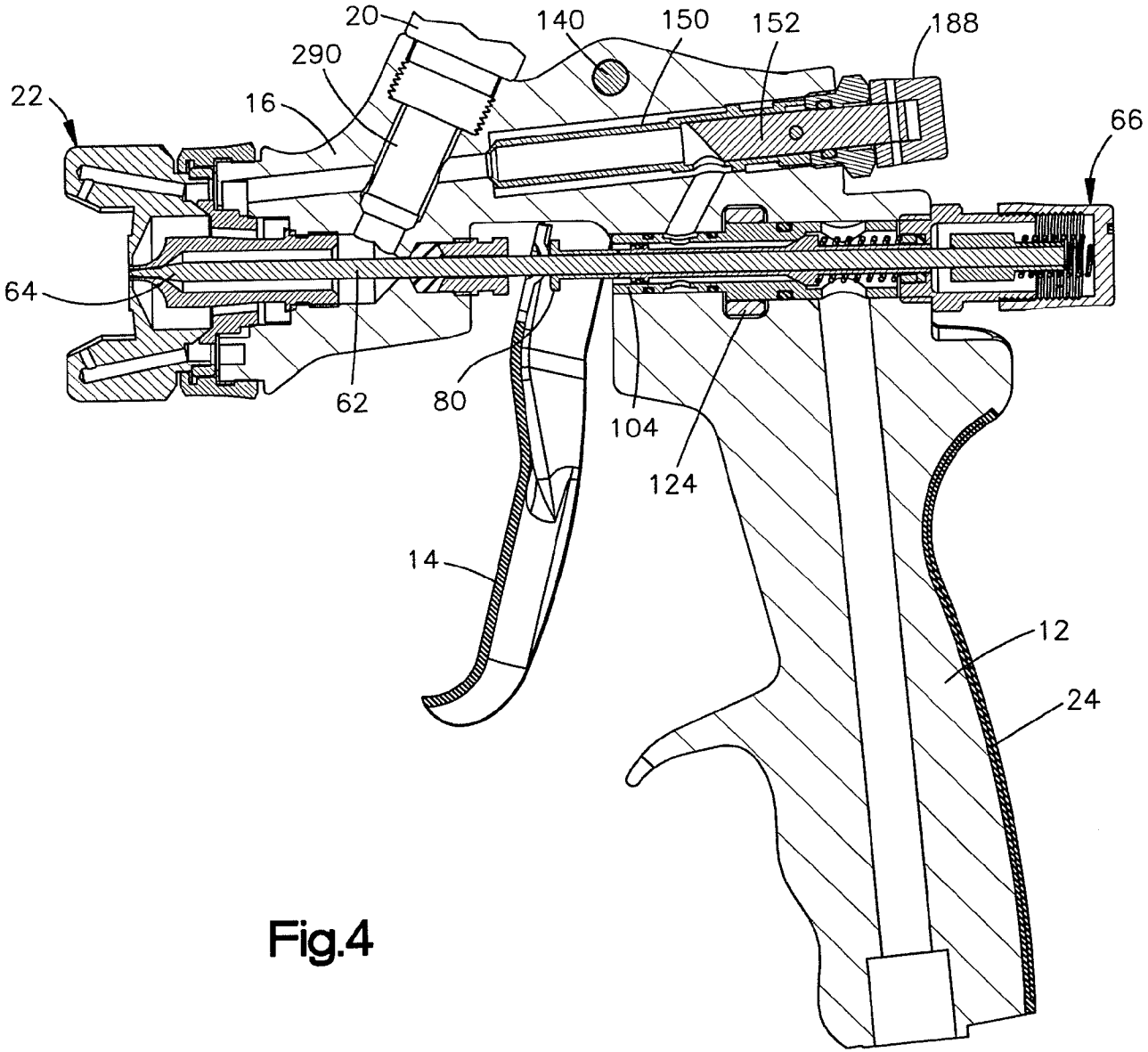
FIG. 4 is a sectional view similar to FIG. 3, showing other parts of the spray gun.

The flow control devices are arranged within the housing 16 as shown in FIG. 4. Several of the flow control devices are arranged along the horizontal axis 33. These include a fluid needle 62. The needle 62 reaches forward to the nozzle assembly 22, and is retractable from a normally closed position in which it blocks paint from flowing outward through the nozzle assembly 22. An adjustment device 66 at the rear of the spray gun 10 sets the force with which the needle 62 is held in the closed position. The adjustment device 66 also sets the range of movement of the needle 62 relative to the nozzle assembly 22 which, in turn, affects the volume of paint sprayed from the nozzle assembly 22 in a known manner.

Figure 5:
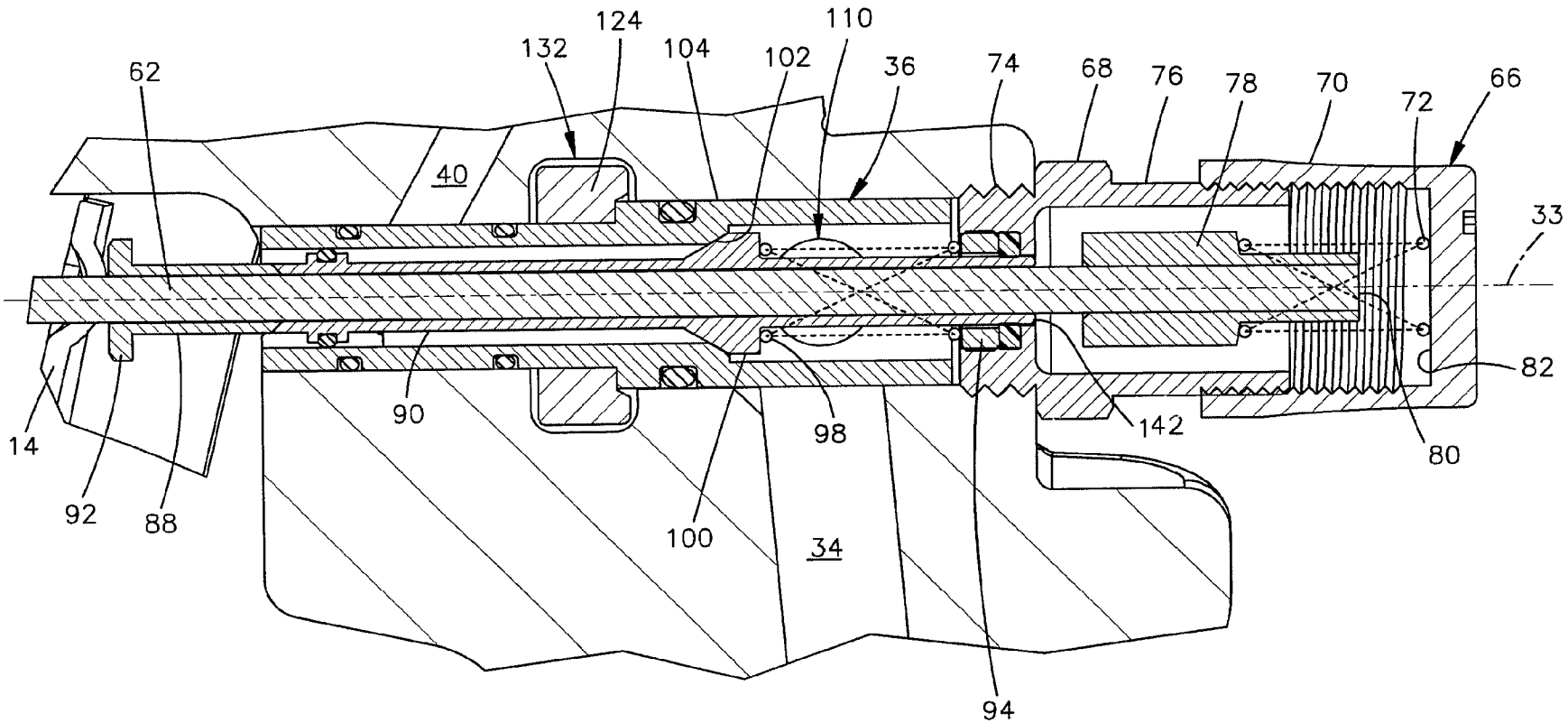
FIG. 5 is an enlarged sectional view of parts shown in FIG. 4.
Figure 6:
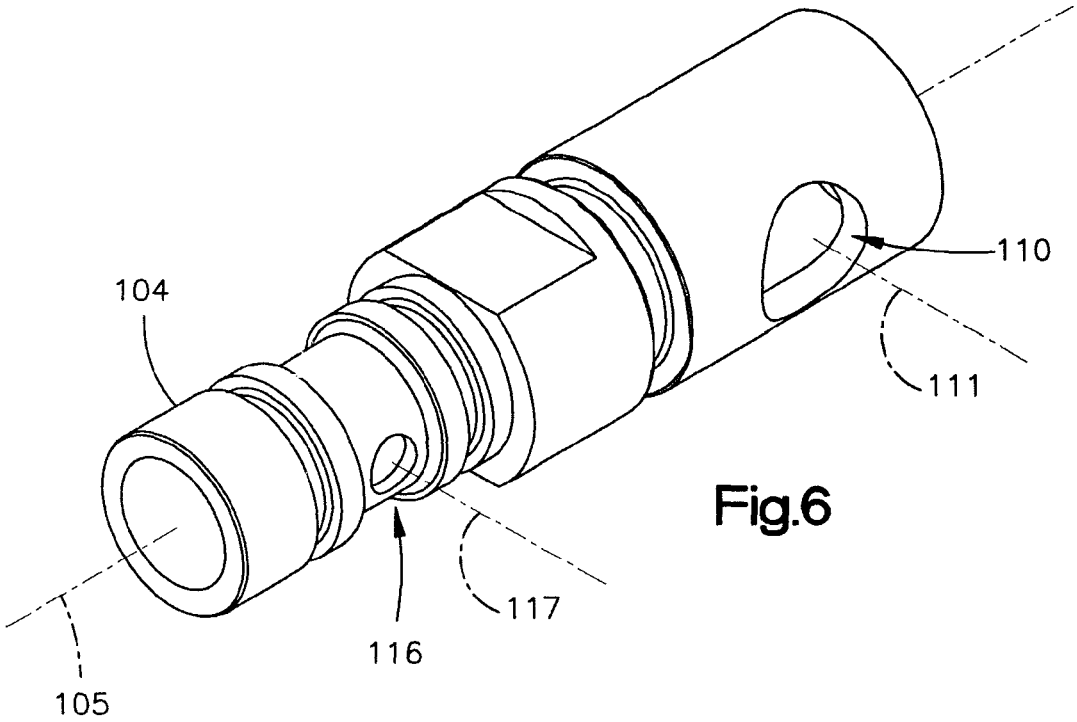
FIG. 6 is a perspective view of a part shown in FIG. 5.
Figure 7:
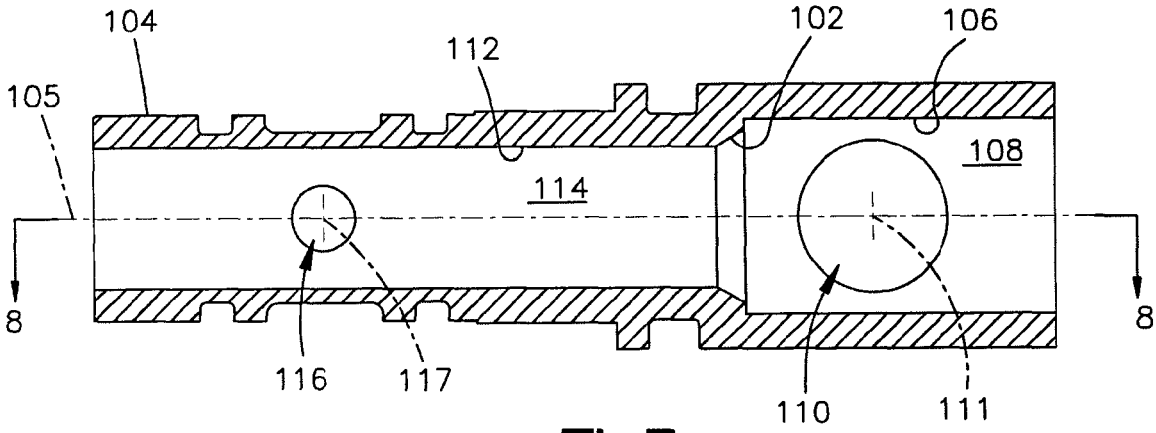
FIG. 7 is a sectional view of the part shown in FIG. 6.
Figure 8:
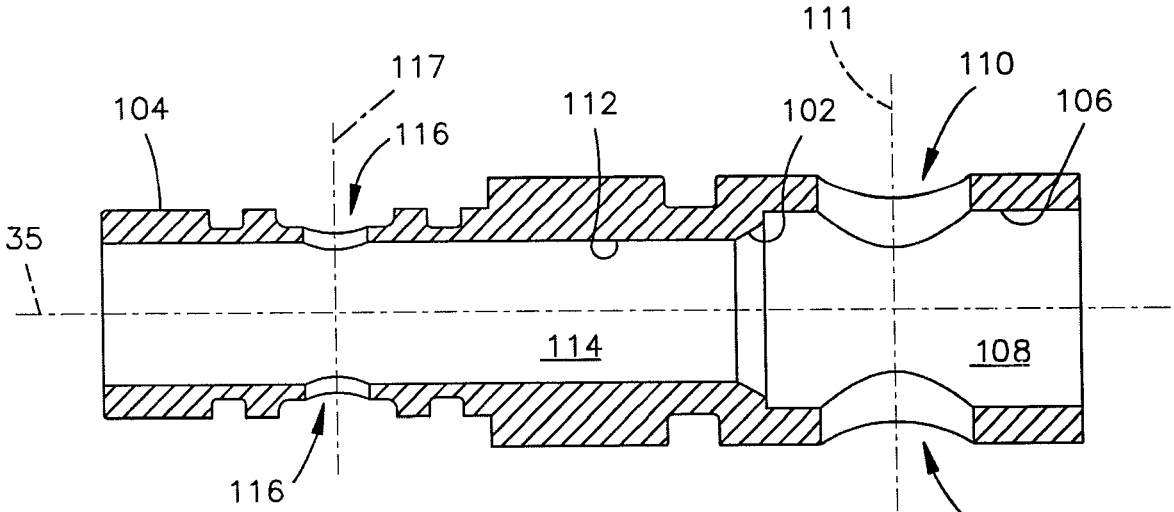
FIG. 8 is a sectional view taken on line 8-8 of FIG. 7.

As shown in enlarged detail in FIG. 5, the adjustment device 66 includes a needle nut 68, a needle cap 70, and a needle spring 72. An inner section 74 of the nut 68 is screwed into the second bore 36 in the housing 16. The cap 70 is screwed onto an outer section 76 of the nut 68. The spring 72 is compressed axially between the cap 70 and a stop member 78 that is press-fitted onto the needle 62. Screwing the cap 72 axially onto or off of the nut 68 increases or decreases the force with which the spring 72 urges the stop member 78 and the needle 62 toward the nozzle assembly 22 at the front of the spray gun 10. This increases or decreases the force required to retract the needle 62 from the closed position. The compressed condition of the spring 72 also determines the distance available for the end 80 of the needle 62 to move axially toward the end wall 82 of the cap 70 when the needle 62 is retracted from the closed position.

As further shown in FIG. 5, a tubular plunger 88 and a needle sleeve 90 are both received over the needle 62. The plunger 88 has a radially enlarged head 92 abutting the trigger 14. The sleeve 90 extends axially inward from the plunger 88, and reaches through a washer nut 94 that is screwed into the needle nut 68. A sleeve spring 98 is compressed axially between the washer nut 94 and a conical portion 100 of the sleeve 90. The conical portion 100 is configured as a valve head for the trigger 14. In the position shown in FIG. 5, the sleeve spring 98 holds the valve head 100 against a surrounding valve seat 102.

The valve seat 102 is a conical inner surface of a regulator 104. As shown separately in FIGS. 6-8, the regulator 104 is a tubular cylindrical part with a longitudinal central axis 105. A first cylindrical inner surface 106 of the regulator 104 defines a chamber 108. A first pair of lateral ports 110 at the chamber 108 extend radially through the regulator 104 on a transverse axis 111 that is perpendicular to the longitudinal axis 105. A second cylindrical inner surface 112 at the opposite side of the valve seat 102 defines a second chamber 114. A second pair of lateral ports 116 at the second chamber 114 extend radially through the regulator 104 on a second transverse axis 117 parallel to the first transverse access 111.

Figure 9:
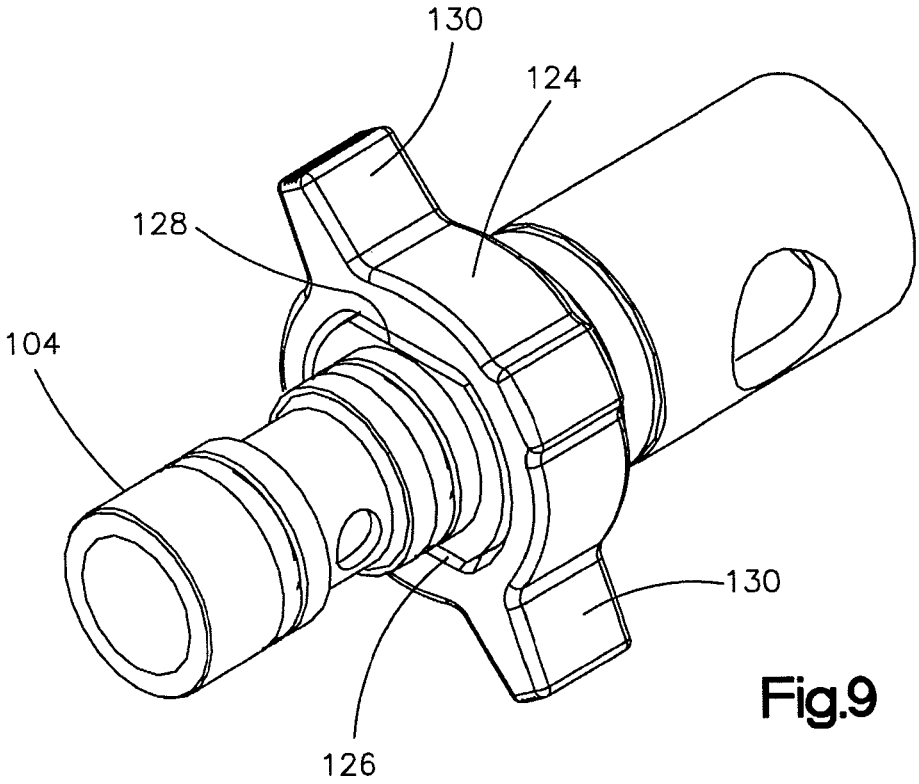
FIG. 9 is a perspective view similar to FIG. 6, showing another part from FIG. 5.

Referring again to FIG. 5, the regulator 104 is received coaxially within the second bore 36 in the housing 16. A thumbwheel 124 is received over the regulator 104, as best shown in FIG. 9. Internal flats 126 on the thumbwheel 124 adjoin external flats 128 on the regulator 104 such that the regulator 104 rotates with the thumbwheel 124. A pair of diametrically opposed wings 130 on the thumbwheel 124 project radially outward through opposed slots 132 in the housing 16. The wings 130 block the regulator 104 from moving axially relative to the housing 16, but enable the user to rotate the regulator 104 about the axis 37 relative to the housing 16. As shown in FIG. 1, the wing 130 at the left side of the spray gun 10 is accessible by the thumb of a right-handed user. The wing 130 at the right side of the spray gun 10 is similarly accessible by the thumb of a left-handed user.

The thumbwheel 124 has a range of movement of about 90°. This enables the user to shift the regulator 104 throughout a range of movement extending from the fully closed position of FIG. 5 to the fully open position of FIG. 10. Rotating the thumbwheel 124 thus moves one of the first regulator ports 110 circumferentially across the upper end of the air supply passage 34. One of the second regulator ports 116 moves simultaneously and equally across the lower end of the intermediate passage 40. In this manner, the regulator 104 functions as a control valve spool to open, close, and vary the air flow areas that the ports 110 and 116 provide at the ends of the passages 34 and 40. This controls the total amount of air flow through the spray gun 10 from the inlet 18 to the nozzle assembly 22.

Figure 10:
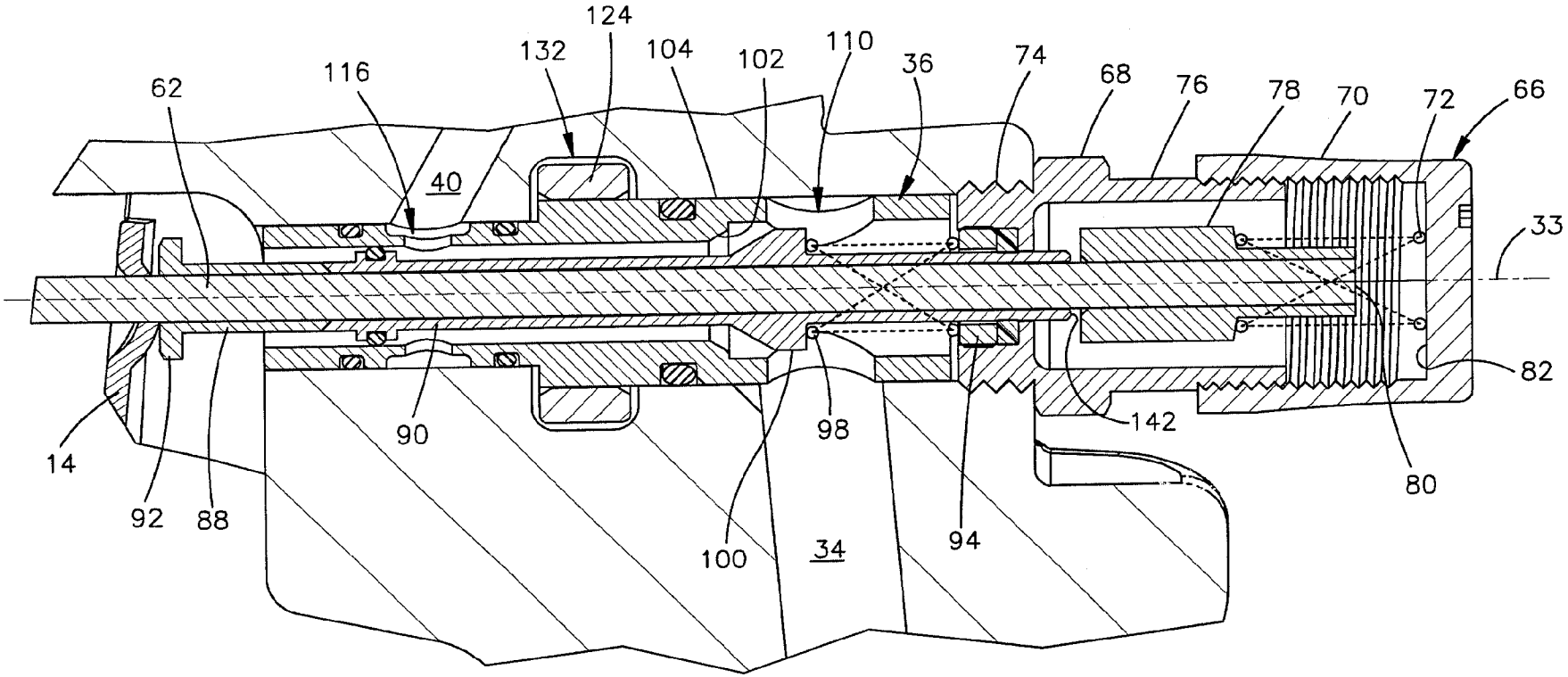
FIG. 10 is a view similar to FIG. 5, showing parts in different positions.

The trigger 14 is mounted on a pivot 140 at the top of the housing 16. When the user pulls the trigger 14 pivotally toward the handle 12, the trigger 14 acts against the plunger 88 (FIG. 5). This causes the plunger 88 to slide over the needle 62 from left to right as viewed in FIG. 5. The plunger 88, which adjoins the sleeve 90 end-to-end, then pushes the sleeve 90 to slide over the needle 62 against the bias of the sleeve spring 98. As shown in FIG. 10, this shifts the valve head 100 off the valve seat 102 to open an air flow passage through the regulator 104 from the port 110 at the supply passage 34 to the port 116 at the intermediate passage 40. As the sleeve 90 continues to slide over the needle 62, the inner end 142 of the sleeve 90 moves into abutment with the stop member 78 on the needle 62. Further axial movement of the sleeve 90 then pushes the stop member 78 and the needle 62 against the bias of the spring 72 to retract the needle 62 from its closed position in the nozzle assembly 22.

Figure 11:
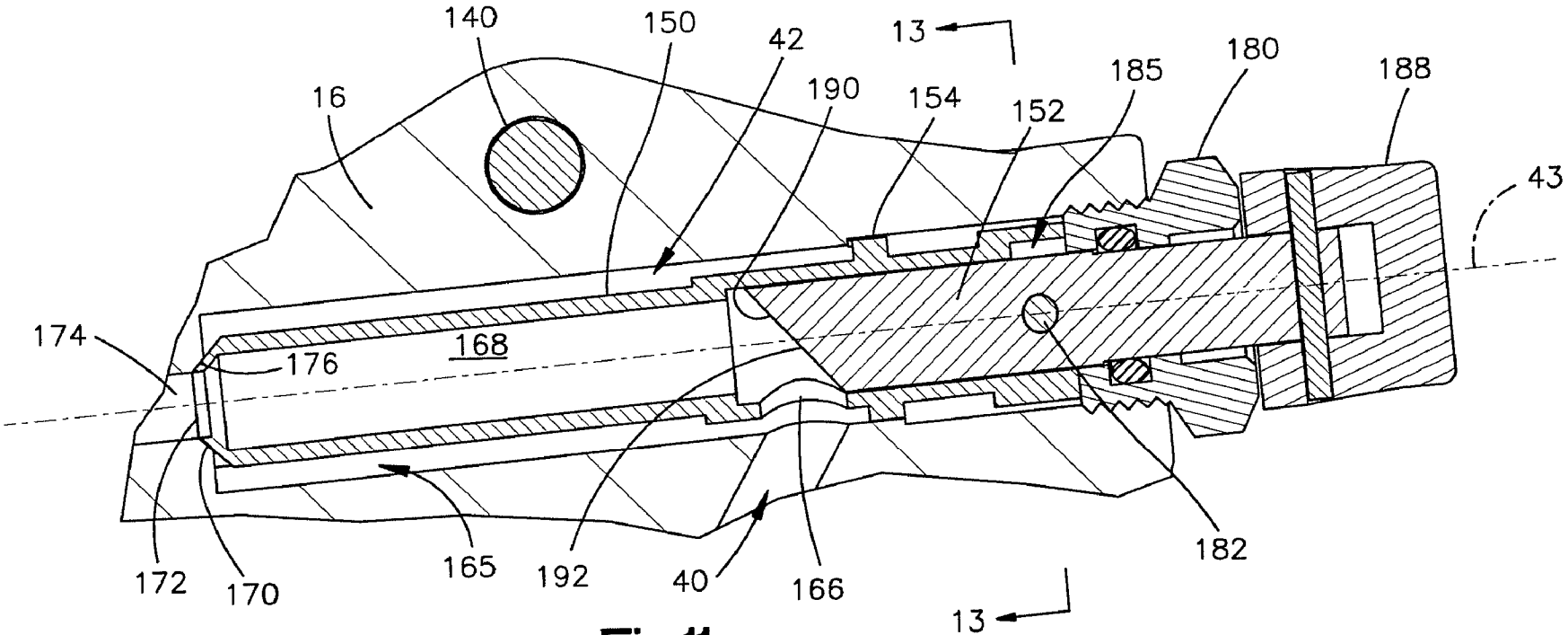
FIG. 11 is an enlarged view of other parts shown in FIG. 4.
Figure 12:
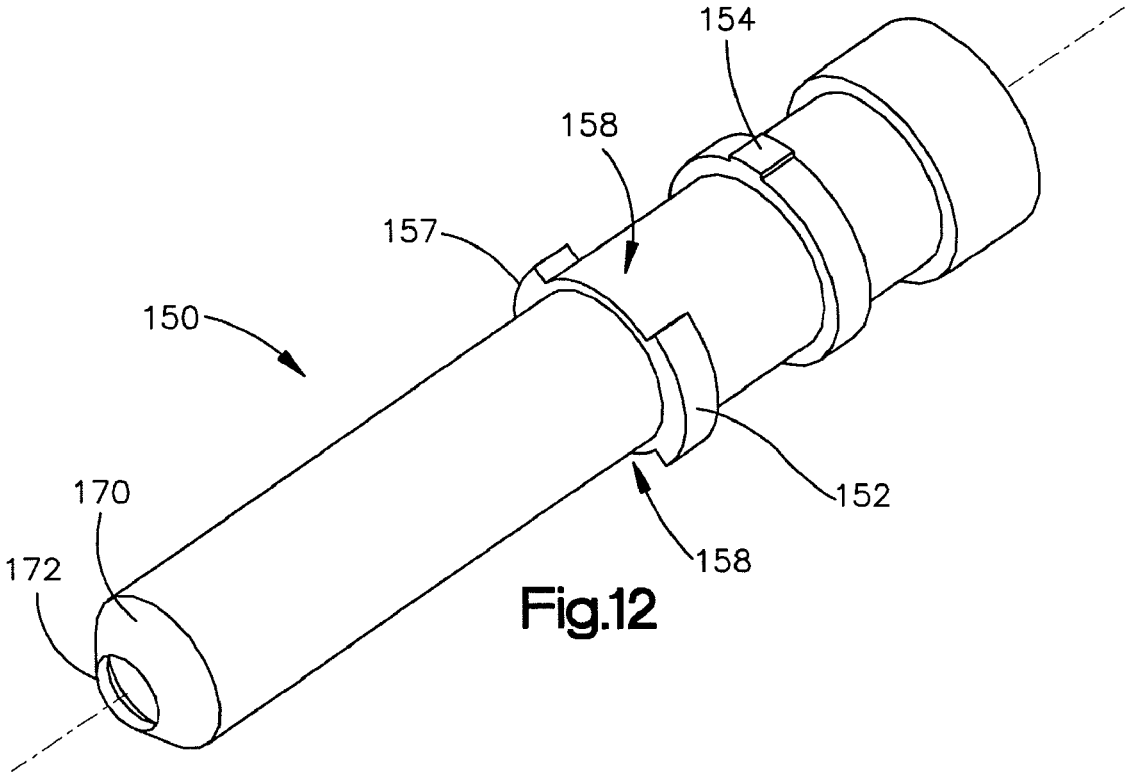
FIG. 12 is a perspective view of a part shown in FIG. 11.

Additional flow control devices are arranged along the inclined axis 43 of the third bore 42. As shown in FIG. 11, they include a sleeve 150 and an insert 152. The sleeve 150 is a cylindrical part received co-axially within the bore 42. A key 154 at the top of the sleeve 150 fits into a notch 156 (FIG. 3) in the housing 16 to block the sleeve 150 from rotating relative to the housing 16. A pair of external radial projections 157(FIG. 12) on the sleeve 150 are spaced apart to define a pair of circumferentially extending gaps 158. The projections 157 engage the housing 16 to align the sleeve 150 coaxially within the bore 42. The gaps 158 provide space for air from the intermediate passage 40 to flow over the sleeve 150 and into an annular air flow space 165 that is located radially between the sleeve 150 and the surrounding housing 16.

A circular port 166 extends radially through the sleeve 150. The port 166 is aligned with the upper end of the intermediate passage 40 for air to flow from the passage 40 to the interior 168 of the sleeve 150. A conical inner end surface 170 of the sleeve 150 surrounds a circular port 172 that is centered on the axis 47. That port 172 communicates the sleeve interior 168 with a downstream section 174 of the bore 42. The conical surface 170 of the sleeve 150 abuts an opposed conical surface 176 of the housing 16 to block air flow between the annular space 165 and the downstream section 174. However, the twin passages 56 in the housing 16, which are located on opposite sides of the fourth bore 50 as described above with reference to FIG. 3, have their upper ends 56 in the annular space 165 to receive air from the annular space 165. A nut 180 at the outer end of the bore 42 presses against the sleeve 150 to hold it firmly in place.

Figure 13:
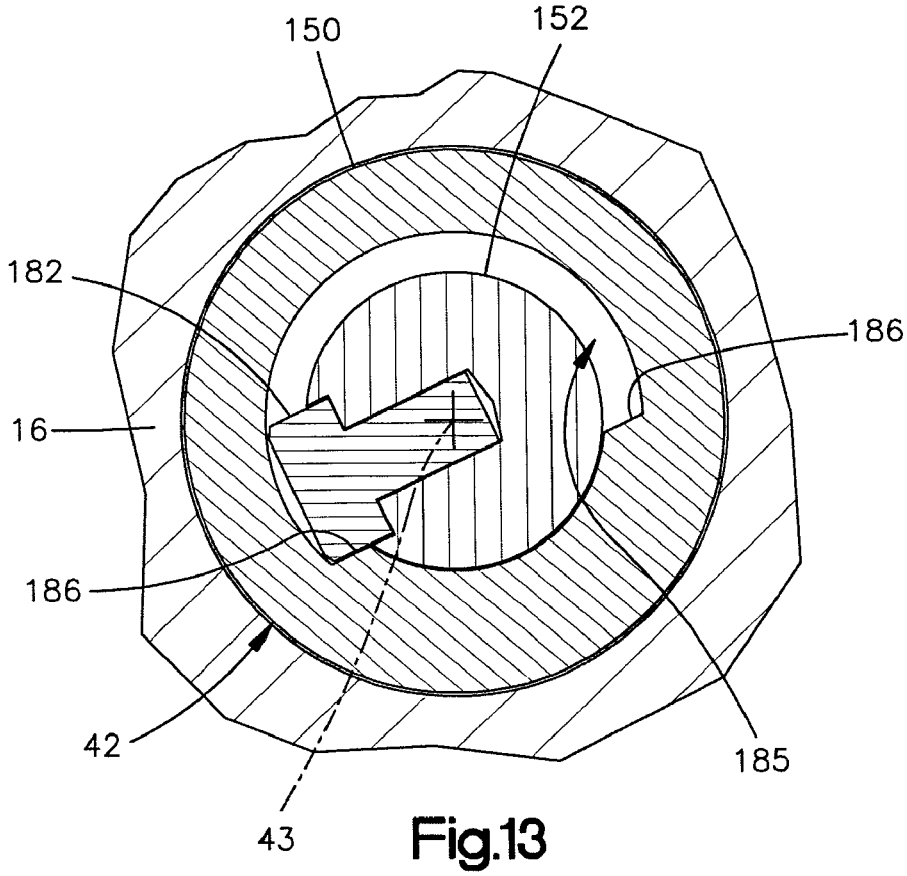
FIG. 13 is a sectional view taken on line 13-13 of FIG. 11.

The insert 152 is a cylindrical part received closely within the sleeve 150 for rotation about the axis 43 relative to the sleeve 150. As shown in FIG. 13, a pin 182 on the insert 152 projects radially into an arcuate slot 185 in the sleeve 150. The nut 180 and the sleeve 150 block the pin 182 from moving axially. Stop surfaces 186 at the opposite ends of the slot 185 provide the pin 182 with a 180° range of movement rotationally about the axis 43. A knob 188 mounted on the end of the insert 152 enables the user to rotate the insert 152 to any selected position within that range of movement.

Figure 14:
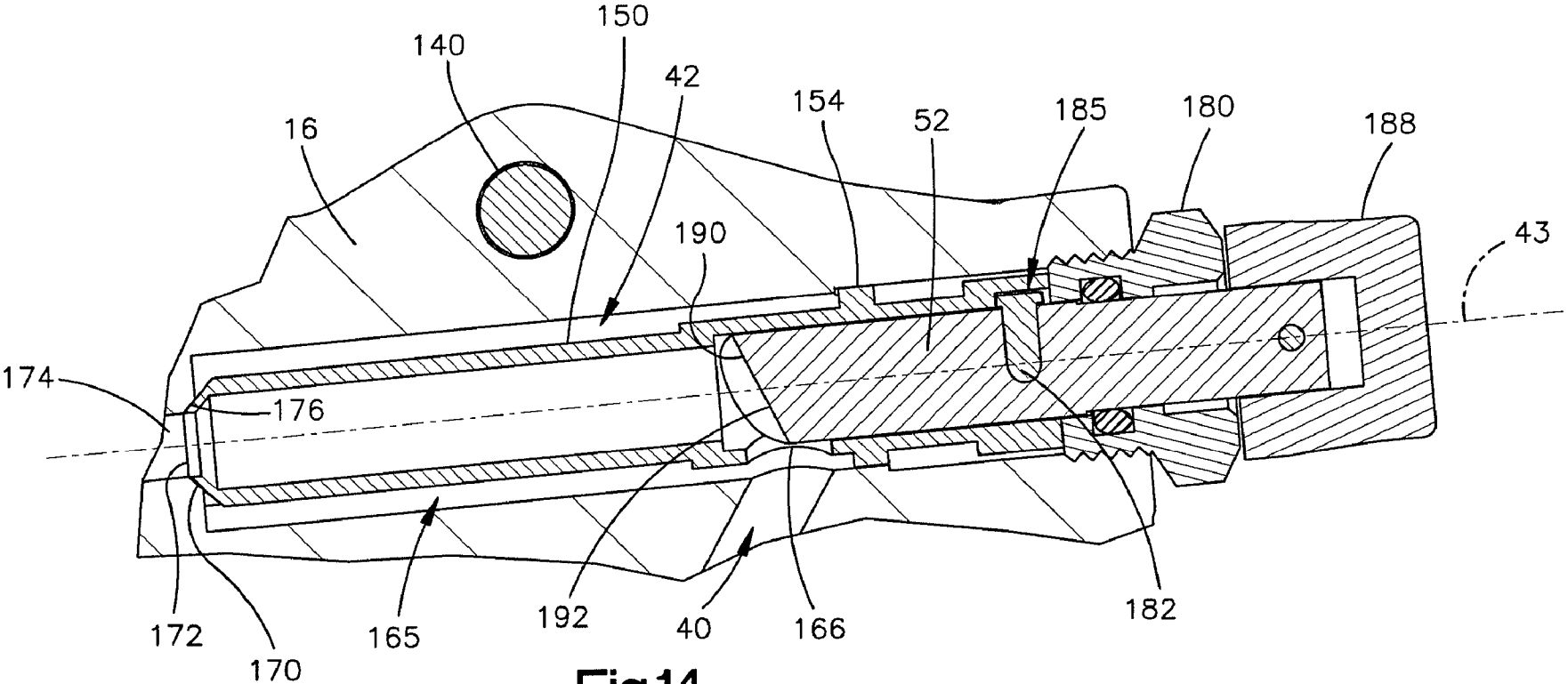
FIG. 14 is a view similar to FIG. 11, showing parts in different positions.

The insert 152 is configured as a rotatable valve stem for opening, closing, and varying the air flow area provided through the port 166 in the sleeve 150. Specifically, the insert 152 has an inclined, planar inner end surface beside the port 166. When the insert 152 is rotated out of the fully open position shown in FIG. 11, the peripheral edge 192 of the rotating end surface 190 advances axially across the port 166. For example, rotating 90° about the axis 47 will advance the edge 192 half way across the port 166, as shown in FIG. 14. Rotating an additional 90° will advance the edge 192 fully across the port 166 to close the port 166. The peripheral edge 192 thus functions as a throttling edge for controlling the flow of air into the sleeve 150 through the port 166. The air that does not flow into the sleeve 150 through the port 166 will instead flow through the annular space 165 and into the twin passages 56 (FIG. 3).

Figure 15:
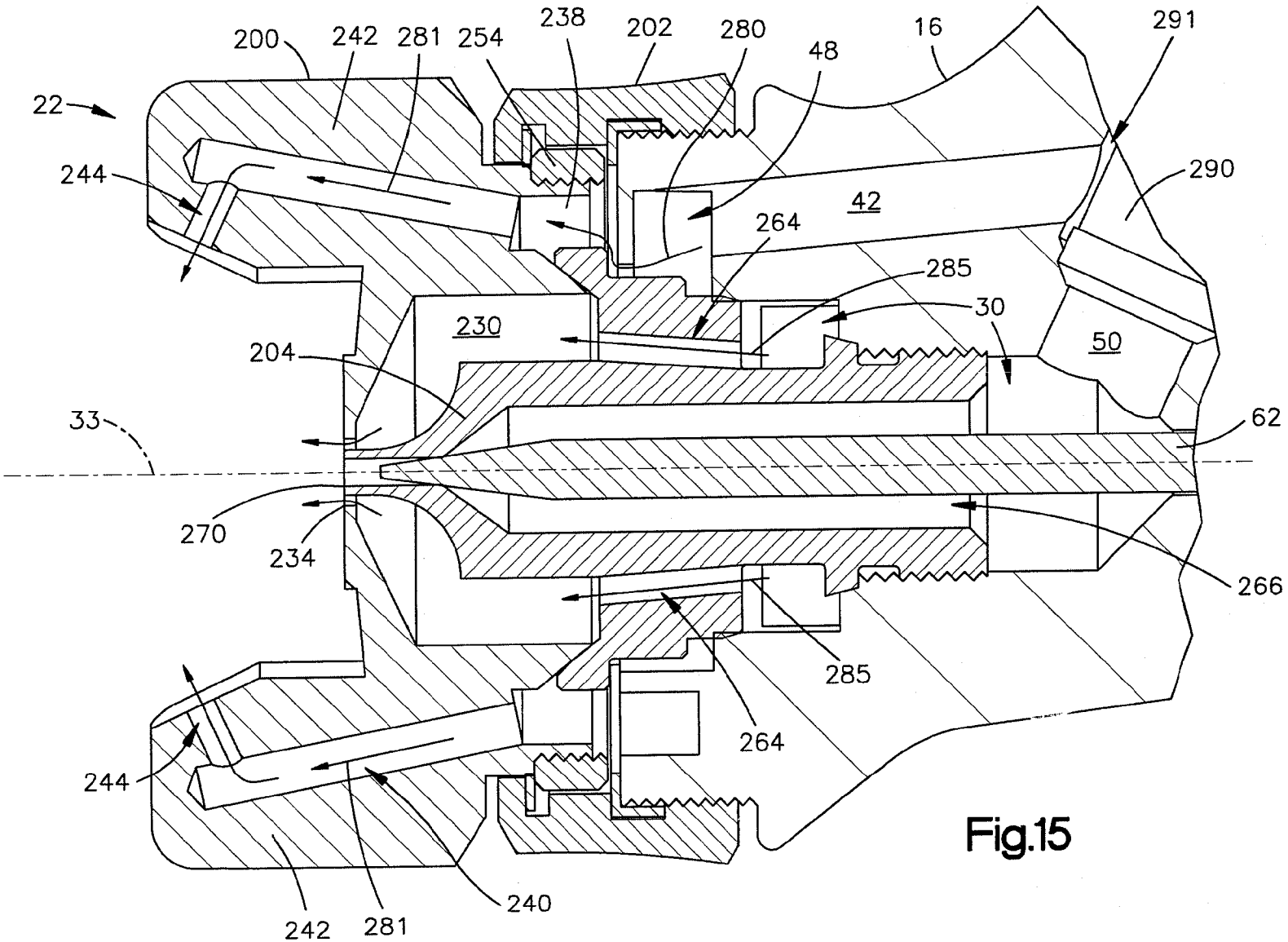
FIG. 15 is an enlarged sectional view of parts shown in FIG. 4.
Figure 17:
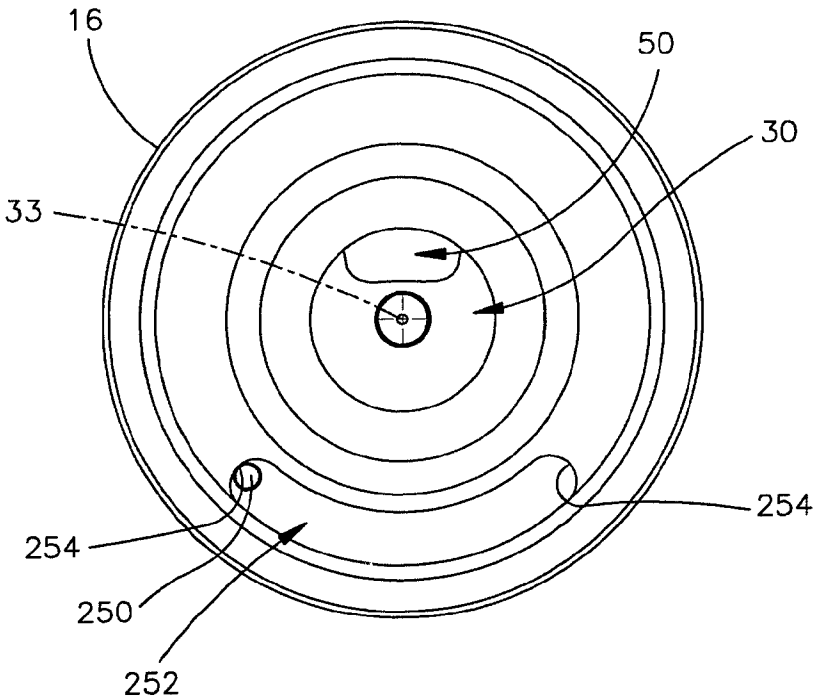
FIG. 17 is a sectional view of another part shown in FIG. 15.

The nozzle assembly 22 includes an air cap 200 and a locking ring 202. As shown in FIG. 15, the air cap 200 and the locking ring 202 are received concentrically over a nozzle 204 at the center of the nozzle assembly 22. The nozzle 204 is screwed into the first bore 30 in the housing 16. The locking ring 202 is screwed onto the housing 16 to retain the air cap 200 in place over the nozzle 204. A bushing 206 is screwed onto the air cap 200, and is captured axially between the locking ring 202 and the housing 16. In this arrangement, the bushing 206 and the air cap 200 can not move axially, but can rotate together about the axis 33 relative to the locking ring 202 and the housing 16.

Figure 16:
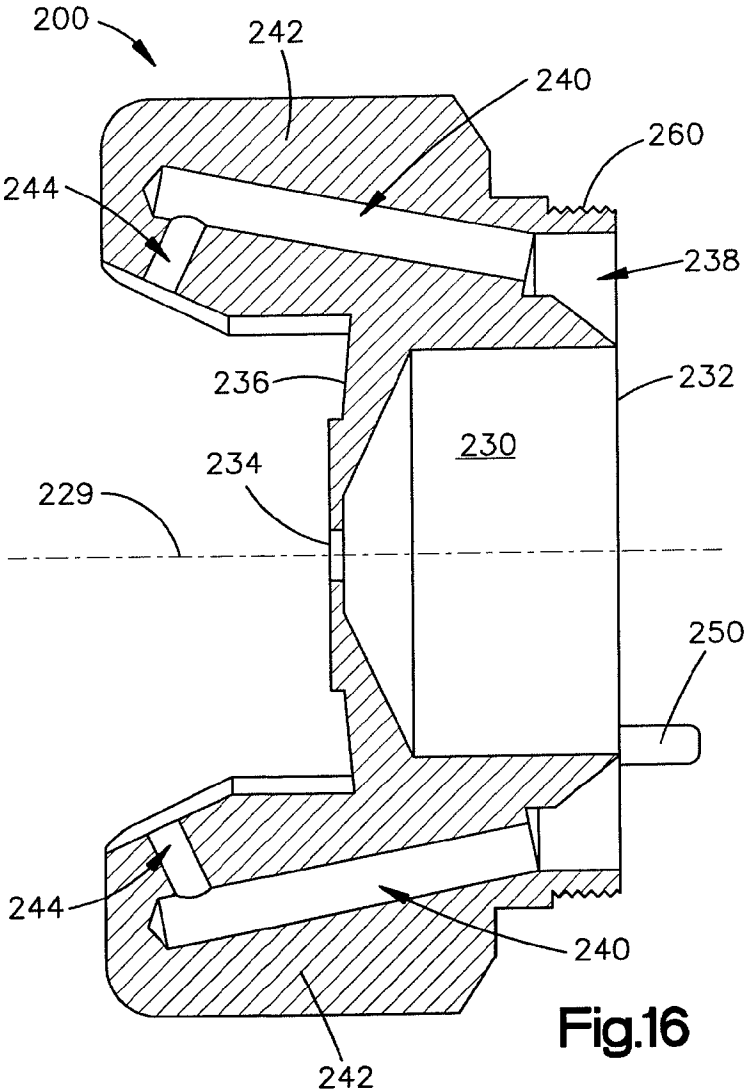
FIG. 16 is a separate view of a part shown in FIG. 15.

The air cap 200, which is shown separately in FIG. 16, is a generally circular part with a longitudinal central axis 229. A central chamber 230 extends into the air cap 200 from the rear side 232, and has a circular outlet port 234 centered on the axis 229 at the front side 236. An annular chamber 238 extends inward from the rear side 232 at a location radially outward of the central chamber 230. A pair of passages 240 extend forward from the annular chamber 238 through a pair of horns 242 that are located diametrically opposite each other. The horn passages 240 have outlet sections 244 inclined toward the axis 229.

The front end of the housing 16 serves as a non-rotating base for the nozzle assembly 22. Specifically, a pin 250 (FIG. 16) on the air cap 200 projects axially into a slot 252 (FIG. 17) at the front end of the housing 16. The slot 252 has an arcuate configuration centered on the axis 33, and has stop surfaces 254 at its opposite ends. The stop surfaces 254 provide the pin 250 with a 90° range of movement about the axis 33.

Figure 18:
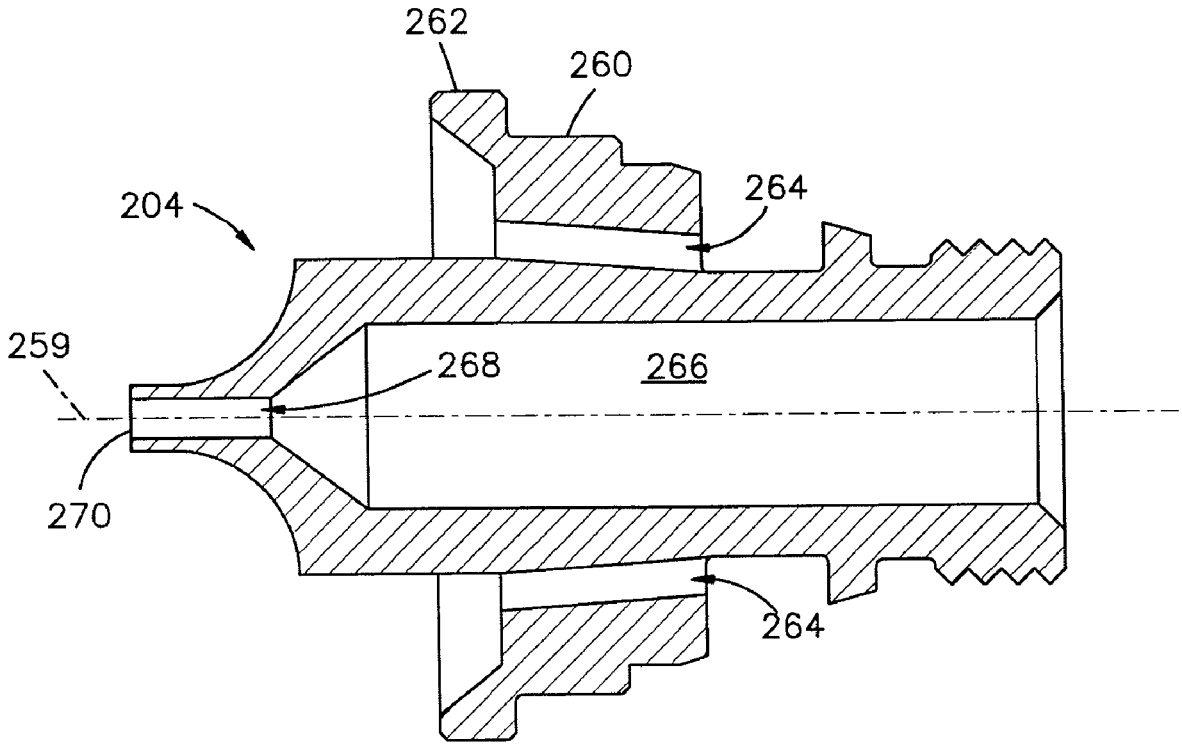
FIG. 18 is an end view of the part shown in FIG. 3.

As shown separately in FIG. 18, the nozzle 204 is a cylindrical part with a longitudinal central axis 259. A peripheral flange portion 260 of the nozzle 204 has a ring-shaped rim 262 at its front end. A plurality of outer passages 264 extend axially through the flange 260 at locations that are evenly spaced apart circumferentially about the axis 259. A central passage 266 extends axially through the nozzle 204, and has a forward section 268 with a circular port 270 at its front end. When the needle 62 is in the closed position, it extends into the forward section 268 of the passage 266 as shown in FIG. 15, and is retractable from that position.

Air flow paths through the nozzle assembly 22 are indicated by arrows in FIG. 15. These include an air flow path 280 that extends from the third bore 42 and the front end passage 48 into the annulus 238 at the rear of the air cap 200. Air from the annulus 238 can flow along paths 281 extending through the horn passages 240 and outward from their outlet sections 244. Additional flow paths 285 receive air from the lower ends 60 (FIG. 3) of the twin passages 56, and extend through the nozzle passages 264 from the central bore 32 in the housing 16 to the central chamber 230 in the air cap 200. Those air flow paths 285 extend further outward through the port 234 in the air cap 204.

An outlet stem 290 (FIG. 15) on the paint container 20 fits into the fourth bore 50 in the housing 16. The stem 290 and the fourth bore 50 together provide clearance 291 for air from the third bore 42 to flow through the fourth bore 50 where those two bores 42 and 50 intersect. Paint from the outlet stem 290 flows from the fourth bore 50 into the first bore 30, and further into the central nozzle passage 266. When the user depresses the trigger 14, the trigger valve head 100 (FIG. 10) opens. This permits pressurized air to flow through the regulator 104 from the supply passage 34 to the intermediate passage 40, and onward to the nozzle assembly 22, at a flow rate determined by the thumbwheel position of the regulator 104. As the user continues to depress the trigger 14, the needle 62 retracts from the closed position of FIG. 15 to permit the paint to flow outward from the nozzle port 270. The paint is then atomized and sprayed outward from the nozzle port 270 by the air emerging from the air cap port 234.

The user adjusts the flow of pressurized air through the air cap port 234 by turning the knob 188 (FIG. 11). As described above, turning the knob 188 adjusts the flow of air from the intermediate passage 40 through the annular space 165 and further to the nozzle 204 through the twin passages 56 (FIG. 3). The paint spray pattern can be flattened from a circular shape to an oval or fan shape by opposed streams of air from the horns 242. The user adjusts those streams by turning the knob 188 to adjust the flow of air from the intermediate passage 40 into the sleeve 150 through the sleeve port 166. That flow of air proceeds from the sleeve 150 into the downstream section 174 of the third bore 42, and from the third bore 42 to the horns 242 along the flow paths 280 and 281 of FIG. 15. Finally, the rotational position of the fan-shaped spray pattern is adjusted by rotating the air cap 200.

Second Embodiment

A second spray gun 400 is shown in FIGS. 19-28. Like the first spray gun 10, the second spray gun 400 is a hand-held device with a handle 402 and a trigger 404. The handle 402 is configured as a pistol grip, and is part of a housing 406 that receives pressurized air from a hose connected to an inlet 408 at the bottom of the handle 402. Flow control devices inside the housing 406 cooperate with the trigger 404 for the pressurized air to spray paint outward from a nozzle assembly 410 at the front of the spray gun 400.

Unlike the first spray gun 10, the second spray gun 400 is connected to a paint container 412 that is located beneath rather than above the housing 406. The second spray gun 400 further differs from the first spray gun 10 by including a valve 414 for switching between a pressure mode of operation and a siphon mode of operation.

Figure 20:
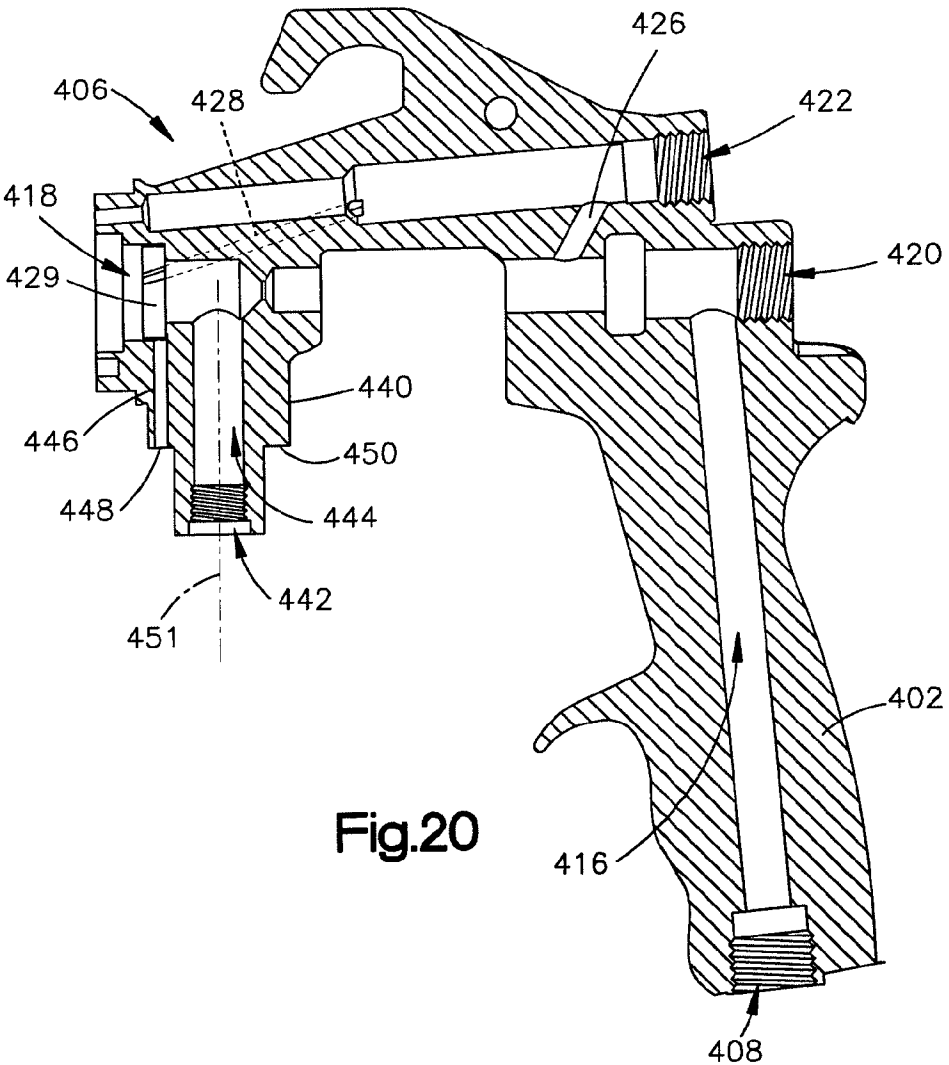
FIG. 20 is a sectional view of a part of the spray gun of FIG. 19.
Figure 19:
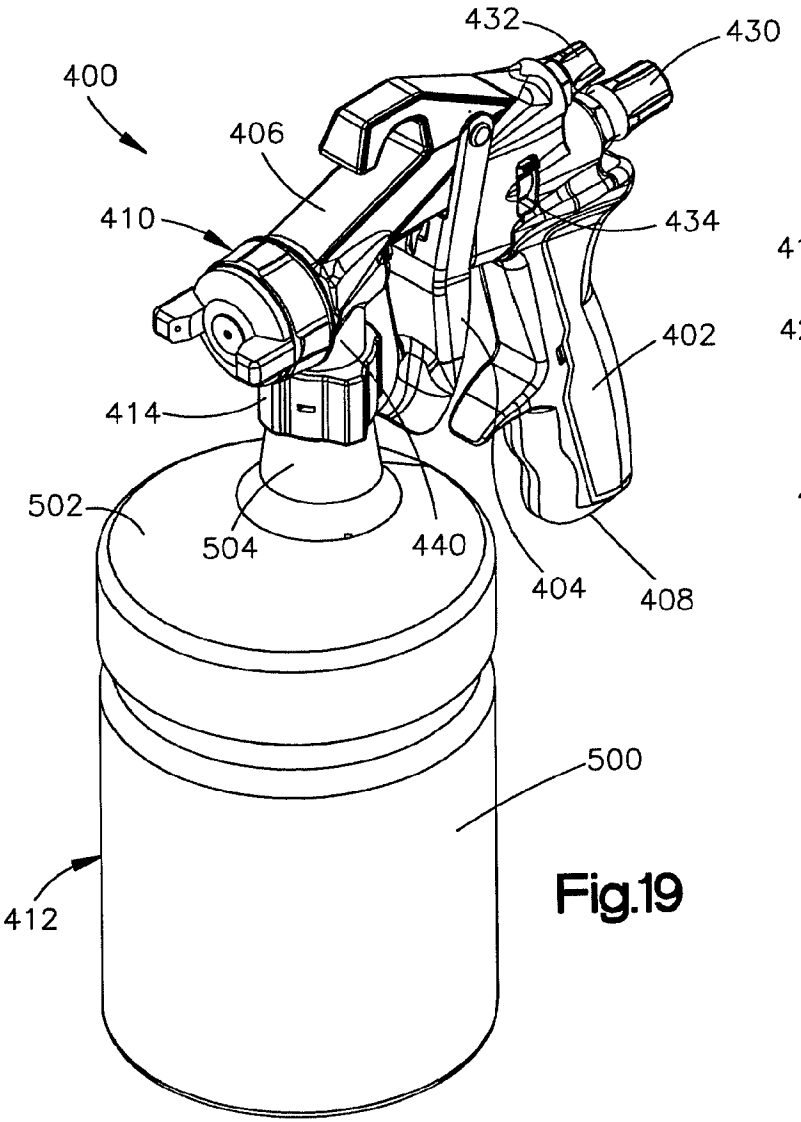
FIG. 19 is a perspective view of a second embodiment of a hand-held paint spray gun with a paint container.

As shown separately in FIG. 20, the housing 406 has an array of bores and passages that together define air and paint flow paths for communicating the inlet 408 with the nozzle assembly 410 and the paint container 412. These include an air supply passage 416 extending upward from the inlet 408 through the handle 402, first, second and third bores 418, 420 and 422, and an intermediate air flow passage 426 extending from the second bore 420 to the third bore 422. Twin passages 428, one of which is shown partially in FIG. 20, extend from the third bore 422 to an annular section 429 of the first bore 418.

The bores and passages in the housing 406 are substantially the same as the corresponding bores and passages described above with reference to the housing 16, and have flow control devices that likewise are substantially the same as their counterparts in the first spray gun 10. This is evident in FIG. 19, which shows an adjustment device 430 that projects outward from the second bore 420, an adjustment knob 432 that projects outward from the third bore 422, and a thumbwheel 434 with wings that project outward from opposite sides of the housing 406. The spray gun 400 is thus equipped with flow control devices that are configured to cooperate with the trigger 404 and the nozzle assembly 410 in the manner described above.

As further shown in FIG. 20, a vertical portion of the housing 406 defines a neck 440 for supporting the paint container 412. The neck 440 has a paint inlet 442 at its lower end. A paint flow passage 444 extends vertically upward from the inlet 442 to the first bore 418 in the housing 406. A smaller air flow passage 446 extends from the annular section region 429 of the first bore 418 vertically downward through the neck 440 to an outlet 448. The outlet 448 is located on an annular shoulder surface 450 of the neck 440 that faces downward and is centered on the axis 451 of the paint flow passage 444.

Figure 21:
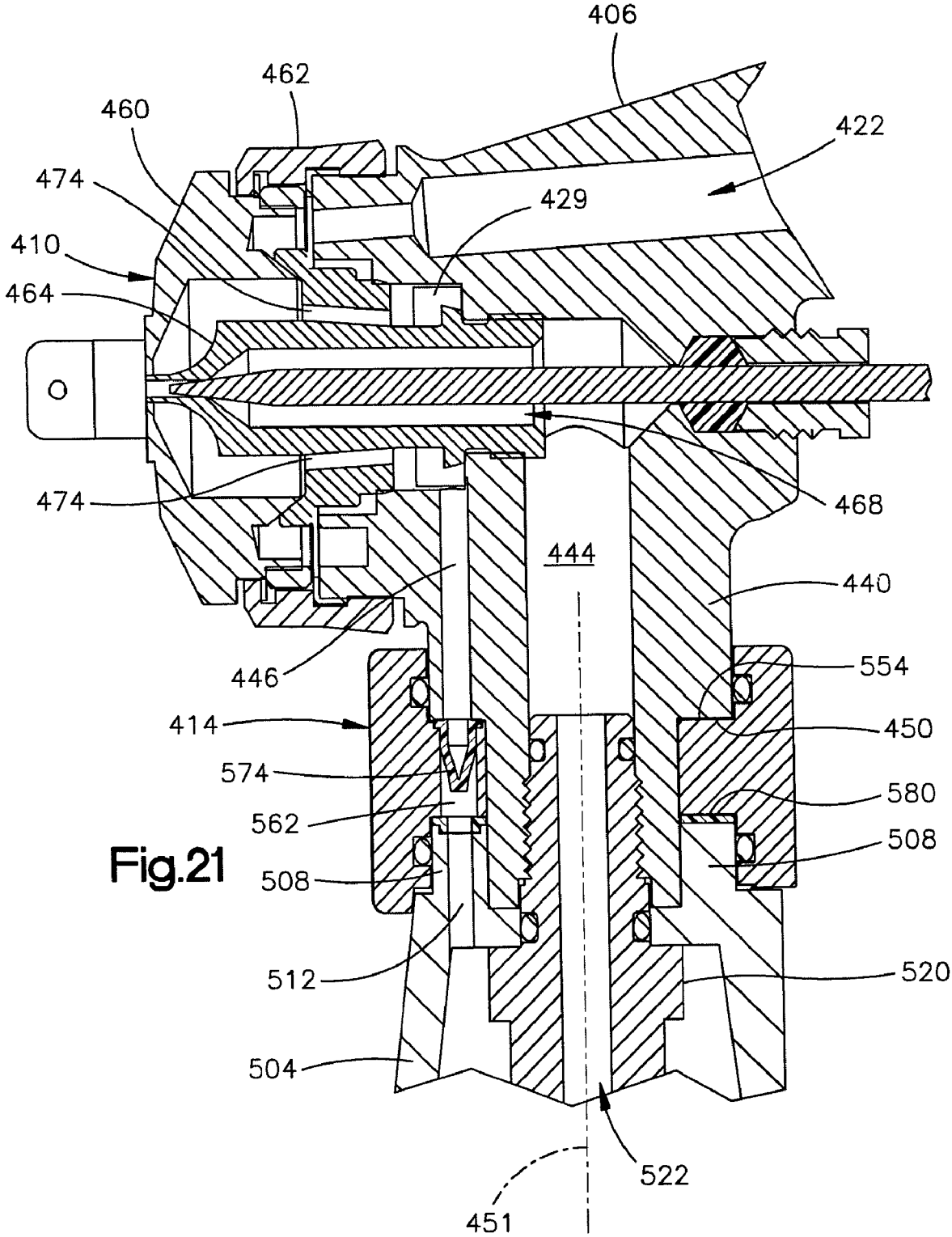
FIG. 21 is an enlarged sectional view of parts of the spray gun of FIG. 19.

As shown in FIG. 21, the nozzle assembly 410 includes an air cap 460, a locking ring 462, and a nozzle 464, each of which is configured and supported at the front end of the housing 406 in substantially the same manner as the corresponding part of the nozzle assembly 22 in the first spray gun 10. The central passage 468 in the nozzle 464 receives paint from the paint flow passage 444. The annular section 429 of the first bore 418 communicates directly with the outer nozzle passages 474. That section 429, which receives pressurized air from the twin passages 428 (FIG. 20), also communicates directly with the air flow passage 446 in the neck 440.

The paint container 412 includes a cup 500 and a lid 502 that are screwed together. The lid 502 has a neck 504 connected to the neck 440 of the housing 406. As shown separately in FIG. 22, the lid neck 504 has a cylindrical rim 506 with an annular upper end surface 508. An air flow passage 512 extends axially downward through the rim 506 from the upper end surface 508 to the interior of the neck 504 beneath the rim 506, as best shown in FIG. 21. As further shown in FIG. 21, a tubular lid stud 520 extends coaxially through the lid neck 504. The lid stud 520 has a paint flow passage 522 that receives paint from the cup 500.

The valve 414 is shown separately in FIGS. 23-26. The valve 414 is a ring-shaped part with a central axis 550. A pair of wings 552 project radially outward at diametrically opposed locations for the user to grasp and rotate the valve 414 about the axis 550. An inner portion 554 of the valve 414 is configured as a circular flange with a cylindrical inner surface 556 and planar opposite sides 558 and 560. An arcuate recess 561 is located at the upper side 558 of the flange 554. An air pressure passage 562 extends from the recess 561 vertically downward through the flange 554 in a direction parallel to the axis 550. A slot-shaped vent passage 566 at the lower side 560 of the flange 554 is spaced from the air pressure passage 562 a short distance circumferentially about the central axis 550. The vent passage 566 extends radially outward from the flange 554 to the exterior of the valve 414. The air pressure passage 562 and the vent passage 566 are entirely separate from each other. A notch 568 at the bottom of the valve 414 has stop surfaces 570 at its opposite ends.

A gasket 572 (FIG. 27) is shaped to fit within the recess 561 at the upper side 558 of the flange 554 in the valve 414. A check valve 574 on the gasket 572 is shaped to project downward into the air pressure passage 562.

The valve 414 is received coaxially over the lid neck 504 as shown in FIG. 21. A second gasket 580 is interposed between the rim 508 and the valve flange 554. A rib 582 (FIG. 22) on the neck 504 projects axially into the notch 568 at the bottom of the valve 414. This enables the valve 414 to rotate relative to the lid neck 504 throughout a range of movement determined by the width of the rib 582 and the arcuate distance between the stop surfaces 570 at the opposite ends of the notch 568. This range of rotational movement is less than 360 degrees, and is preferably less than 90 degrees. In the preferred embodiment the range is about 30 degrees.

With the valve 414 in place on the lid neck 504, those parts are moved into coaxial engagement with the housing neck 440 by screwing the lid stud 520 upward into the housing neck 440. A locator key 584 (FIG. 22) on the lid neck 504 fits into a notch 586 (FIG. 27) on the housing neck 440. This ensures that the air flow passage 446 in the housing neck 440 is aligned with the air flow passage 512 in the lid neck 504. The valve 414 is then centered on the axis 451 of the paint flow passage 444, with the flange 554 captured axially between the second gasket 580 and the annular shoulder surface 450. The valve 414 is thus supported to rotate about the axis 451 while remaining stationary along the axis 451.

The valve 414 is rotatable between open and closed positions to switch the spray gun 400 between the pressure and siphon modes of operation. Specifically, when the valve 414 is at one end of its rotational range of movement, it takes the open position shown in FIG. 21. The air pressure passage 562 through the valve 414 is aligned with the air flow passages 446 and 512 in the housing neck 440 and the lid neck 504. Pressurized air can then flow through those passages into the paint container 412 to force the paint upward through the paint flow passage 444 to the nozzle 464 in the pressure mode of operation. The check valve 574 in the air pressure passage 562 prevents air from escaping the cup 500 when the trigger 14 is released. This enables quick restarting of the paint spraying operation by maintaining the air pressure in the cup 500.

Figure 28:
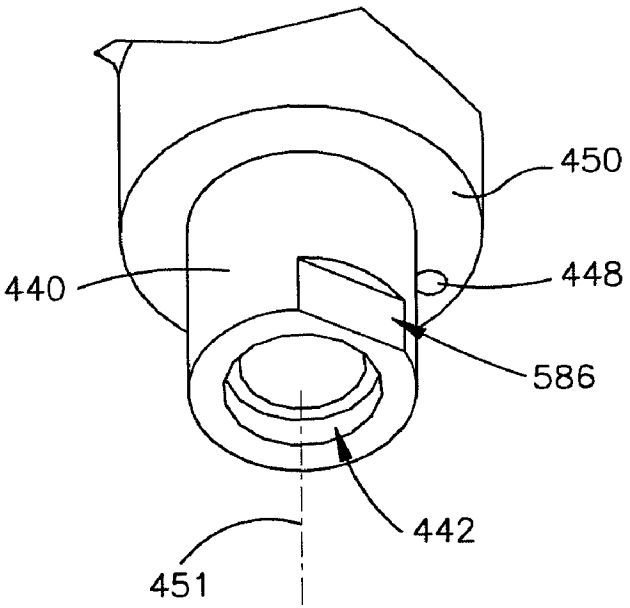
FIG. 28 is an enlarged partial view, taken from beneath, of the part shown in FIG. 20.
Figure 22:
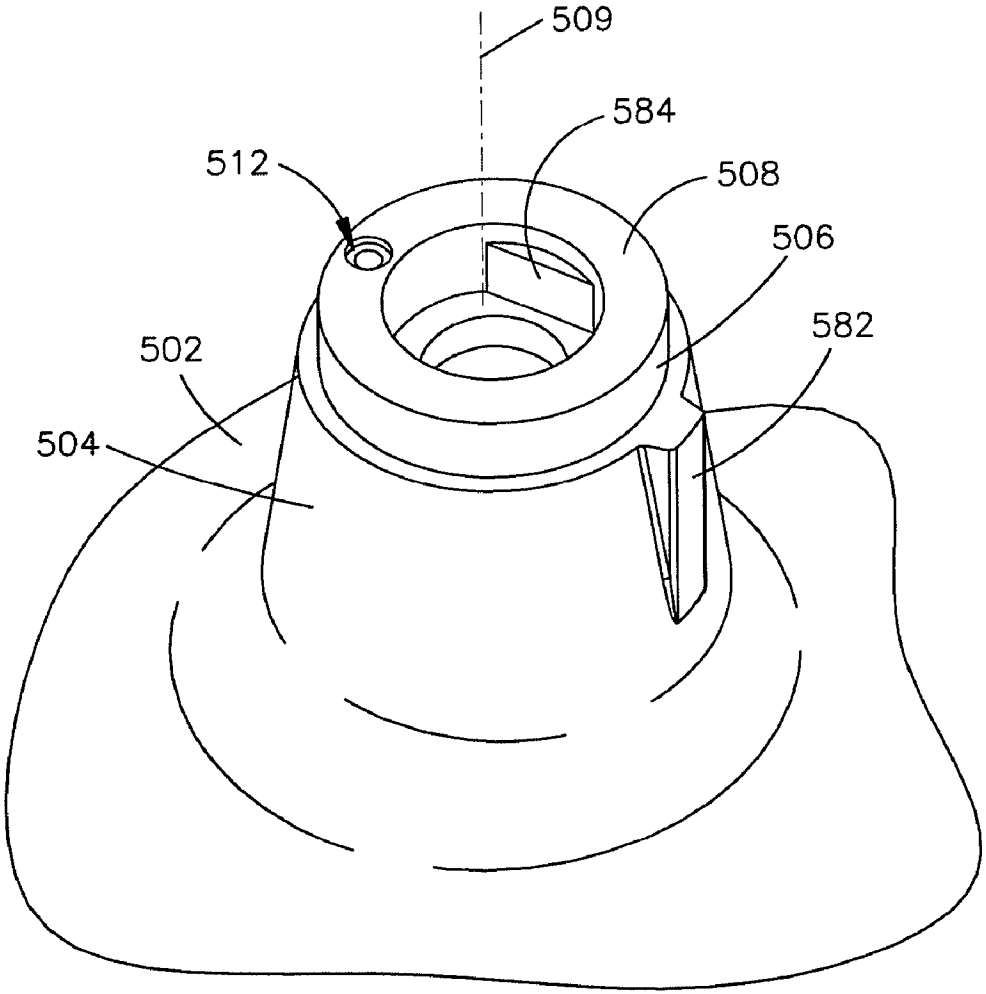
FIG. 22 is an enlarged partial view of a part of the spray gun of FIG. 19.
Figure 24:
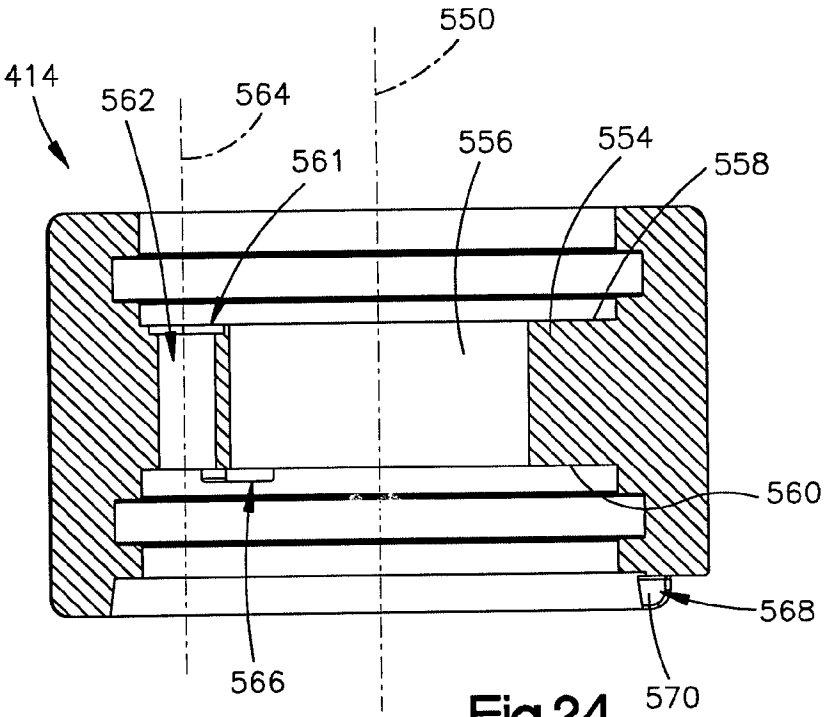
FIG. 24 is a sectional view taken on line 24-24 of FIG. 23.
Figure 27:
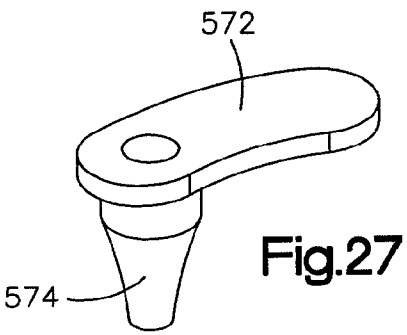
FIG. 27 is perspective view of a part shown in FIG. 21.
Figure 23:
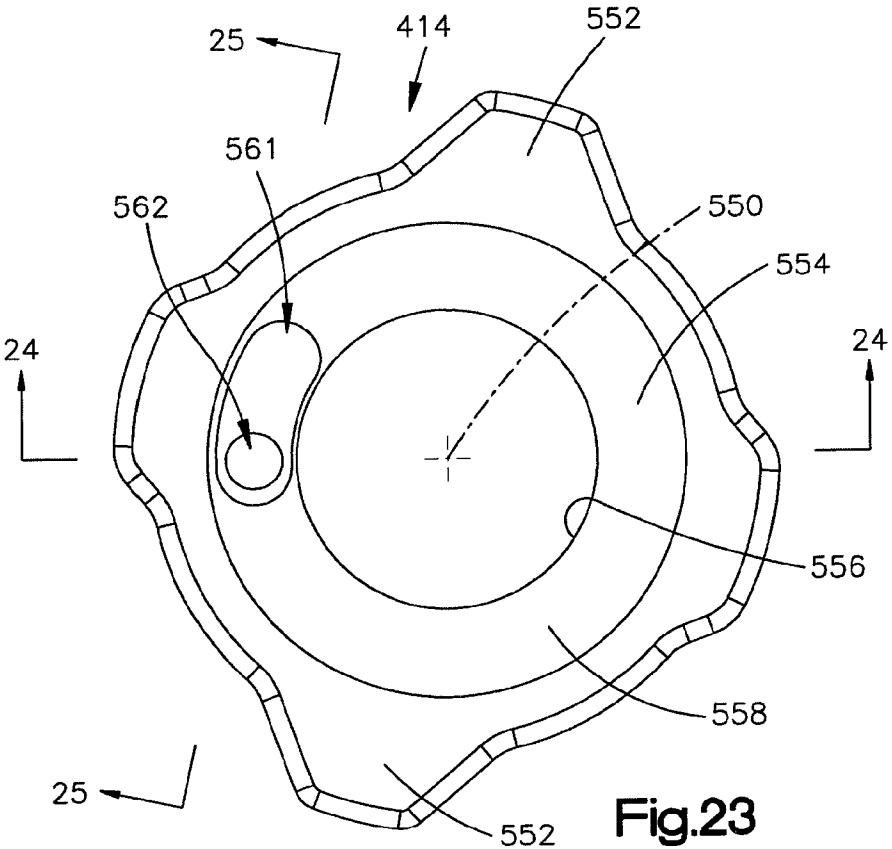
FIG. 23 is a top view of another part of the spray gun of FIG. 19.
Figure 25:
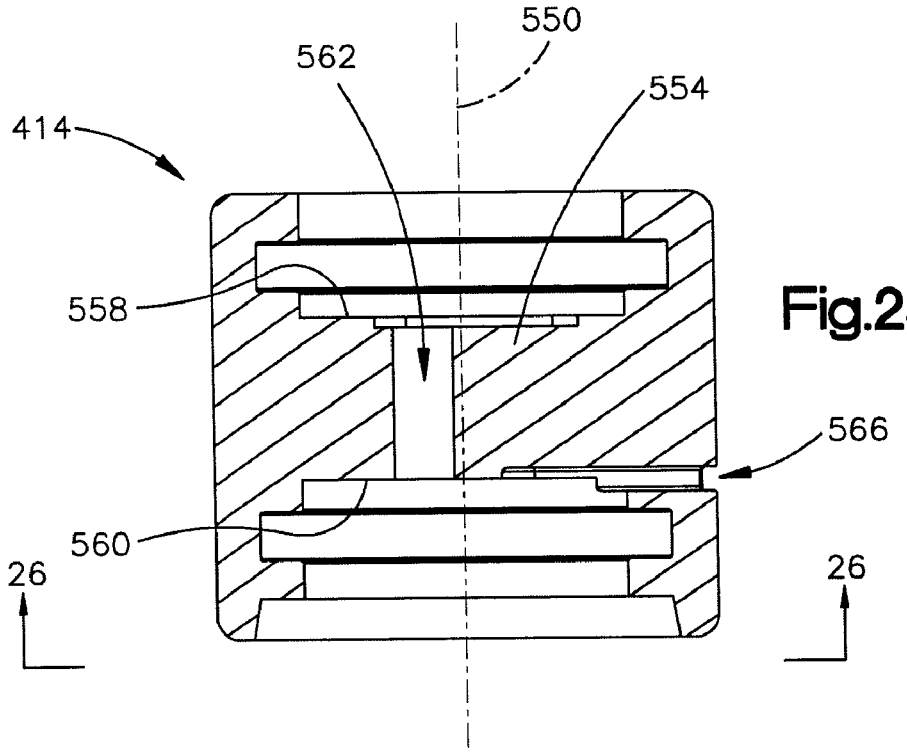
FIG. 25 is a sectional view taken on line 25-25 of FIG. 23.
Figure 26:
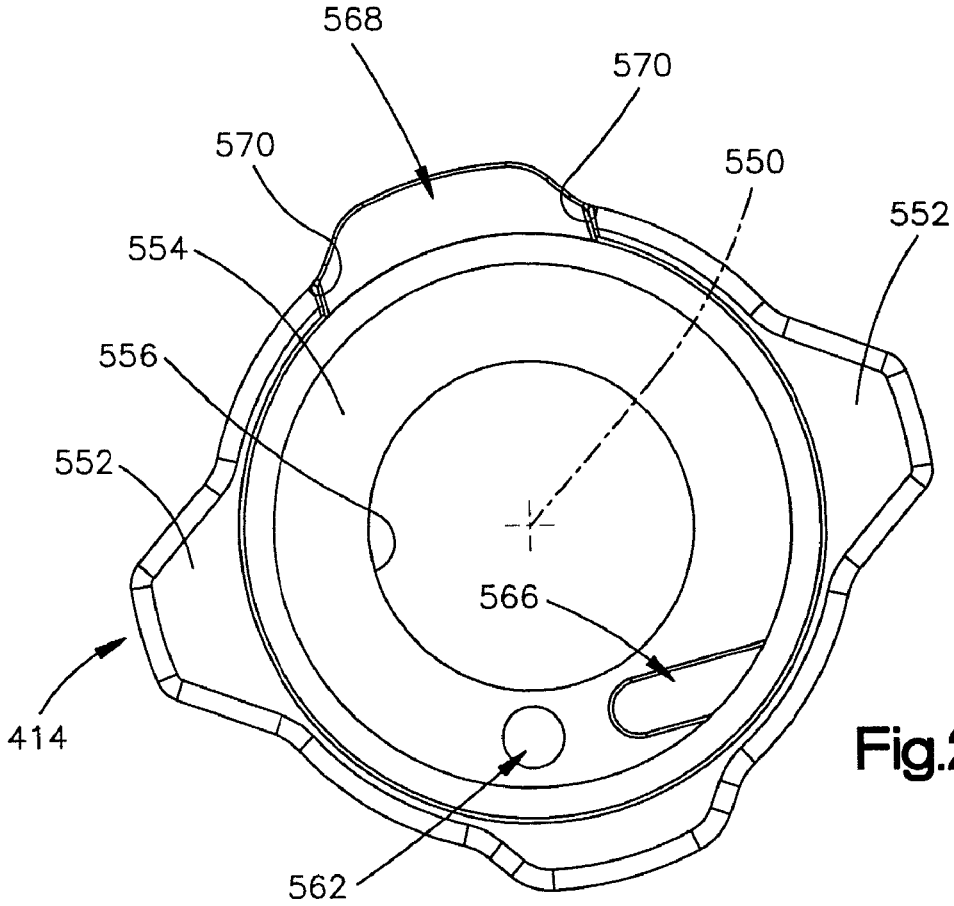
FIG. 26 is a bottom view taken on line 26-26 of FIG. 25.
Figure 29:
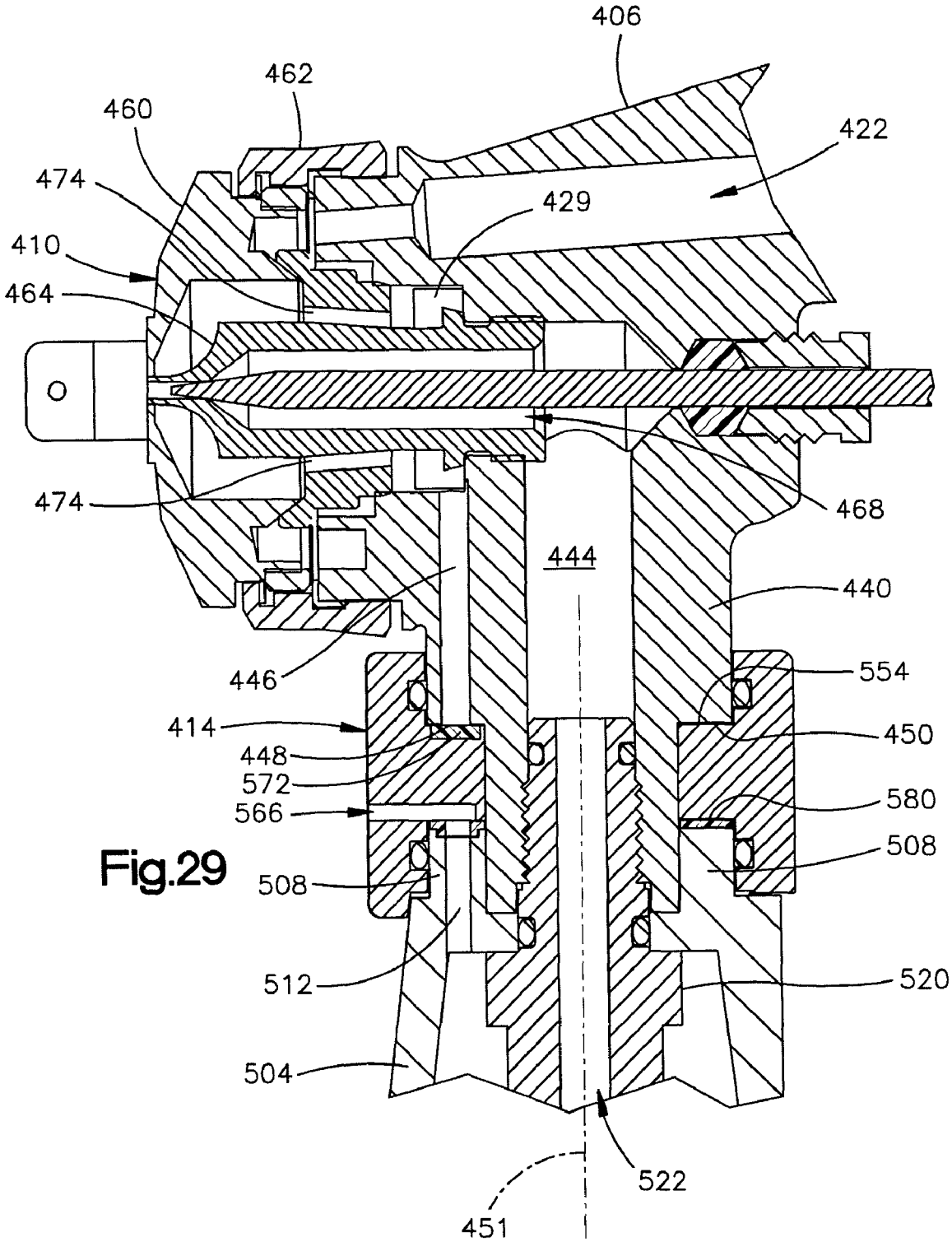
FIG. 29 is a view similar to FIG. 21, showing parts in different positions.

When the valve 414 is at the opposite end of its range, it takes the closed position shown in FIG. 28. The air pressure passage 562 is then spaced circumferentially from the aligned neck passages 446 and 512, and the flange 554 blocks the outlet 448 to prevent the pressurized air from flowing into the container 412. The vent passage 566 is then aligned with the air flow passage 512 in the lid neck 504 for the container 412 to receive atmospheric air in the siphon mode of operation.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that occur to those skilled in the art. Such other examples are intended to be within the scope of the claims if they have elements that do not differ from the literal language of the claims, or if they have equivalent elements with insubstantial differences from the literal language of the claims.

The invention claimed is:

1. An apparatus comprising:

a paint container;

a nozzle assembly configured to receive paint from the paint container;

a housing having a handle, an air inlet, and an air flow path configured to direct pressurized air from the air inlet into the paint container; and a valve configured to place the paint container in a pressure condition in which the pressurized air is directed to flow into the paint container, to place the paint container in a siphon condition in which the paint container is vented to the atmosphere and the pressurized air is blocked from flowing into the paint container, and to shift the paint container between the pressure condition and the siphon condition by rotating about an axis while remaining stationary along the axis.

2. An apparatus as defined in claim 1 wherein the valve comprises a valve body configured to open and close the air flow path upon rotating back and forth between open and closed positions, and the valve body has an axially extending air pressure passage configured to move into and out of alignment with the fluid flow path when the valve body rotates into and out of the open position.

3. An apparatus as defined in claim 2 wherein the valve body further has a vent passage configured to communicate the paint container with the atmosphere when the valve body is in the closed position.

4. An apparatus as defined in claim 3 wherein the air pressure passage and the vent passage are entirely separate from each ether.

5. An apparatus as defined in claim 1 wherein valve comprises a valve body configured to open and close the fluid flow path upon rotating back and forth between open and closed positions, with the valve and container together defining opposite ends of a rotational range of movement of the valve body between the open and closed positions.

6. An apparatus comprising:

a paint container;

a nozzle assembly configured to receive paint from the paint container;

a housing supporting the nozzle assembly, the housing having a handle, an air inlet configured to receive pressurized air from a hose, an air outlet configured to direct pressurized air outward from the housing to the paint container, and air flow paths configured to direct air through the housing from the inlet to the nozzle assembly and the outlet; and a valve mounted on the housing, the valve being configured to place the paint container in a pressure condition in which the pressurized air is directed to flow from the outlet to the paint container, to place the paint container in a siphon condition in which the paint container is vented to the atmosphere through the valve and the pressurized air is blocked from flowing from the outlet to the paint container, and to shift the paint container back and forth between the pressure condition and the siphon condition by rotating about an axis while remaining stationary along the axis.

7. An apparatus as defined in claim 6 wherein the valve comprises a valve body configured to open and close the outlet upon rotating back and forth between open and closed positions, and the valve body has an axially extending air pressure passage configured to move into and out of alignment with the outlet when the valve body rotates into and out of the open position.

8. An apparatus as defined in claim 7 wherein the valve body further has a vent passage that is open to the atmosphere when the valve body is in the closed position.

9. An apparatus as defined in claim 8 wherein the air pressure passage and the vent passage are entirely separate from each other.

10. An apparatus as defined in claim 6 wherein valve comprises a valve body configured to open and close the outlet upon rotating back and forth between open and closed positions, with the valve and container together defining opposite ends of a rotational range of movement of the valve body between the open and closed positions.

* * * * *